US005494190A

United States Patent [19]

Boettcher

[11] Patent Number: 5,494,190

[45] Date of Patent: Feb. 27, 1996

[54] METHOD AND COMBINATION FOR DISPENSING TWO PART SEALING MATERIAL

[75] Inventor: Robert J. Boettcher, Stillwater, Minn.

[73] Assignee: Minnesota Mining and Manufacturing Company, St. Paul, Minn.

[21] Appl. No.: 365,889

[22] Filed: Dec. 29, 1994

[51] Int. Cl.[6] ..... B65D 35/22; B65D 35/28

[52] U.S. Cl. ..... 222/1; 222/94; 222/95; 206/219

[58] Field of Search ..... 222/94.1, 95, 105, 222/135–137, 325–327; 206/219

[56] References Cited

U.S. PATENT DOCUMENTS

| | | | |
|---|---|---|---|
| 1,944,201 | 1/1934 | Wharton | 222/95 |
| 1,965,271 | 7/1934 | Wharton | 222/95 |
| 2,833,444 | 5/1958 | Sherbondy | 222/95 |
| 2,932,385 | 4/1960 | Bollmeier et al. | 206/219 |
| 3,074,544 | 1/1963 | Bollmeier et al. | 206/219 |
| 3,087,606 | 4/1963 | Bollmeier et al. | 206/219 |
| 3,323,682 | 6/1967 | Creighton, Jr. et al. | 222/95 X |
| 3,749,620 | 7/1973 | Montgomery | 206/219 X |
| 4,168,363 | 9/1979 | Boettcher . | |
| 4,711,373 | 12/1987 | Christine | 222/95 X |
| 5,330,074 | 7/1994 | Wirsig et al. | 222/325 X |
| 5,370,221 | 12/1994 | Magnusson et al. | 206/219 X |

FOREIGN PATENT DOCUMENTS

| | | | |
|---|---|---|---|
| 2088998 | 6/1982 | United Kingdom | 222/95 |
| 2186544 | 8/1987 | United Kingdom | 222/95 |
| 8604041 | 7/1986 | WIPO | 222/95 |

OTHER PUBLICATIONS

Parts list dated Nov. 23, 1994 for the "Avon–Manual Sachet Applicator".

*Primary Examiner*—Kevin P. Shaver

*Attorney, Agent, or Firm*—Gary L. Griswold; Walter N. Kirn; William L. Huebsch

[57] ABSTRACT

Quantities of two low viscosity liquid components are provided in separated portions of a flexible bag or package. Separable attachment of package walls between the liquid components is broken, and the liquids are mixed together within the package by manipulating its flexible walls. The flexible package containing the mixed components is inserted into a barrel of a dispenser, and a portion of the package adjacent the front end of the barrel is removed. A nozzle is attached to the front end of the barrel, and a driving mechanism is manually activating to drive a plunger along the barrel toward the nozzle to compress the flexible package and thereby dispense the material in the package through the nozzle. When mixed the liquid components first form a higher viscosity, non-sag, non-flowing, thixotropic composition for a period of time during which dispensing from the dispenser can occur, and thereafter form a resiliently flexible solid sealing composition.

5 Claims, 3 Drawing Sheets

METHOD AND COMBINATION FOR DISPENSING TWO PART SEALING MATERIAL

FIELD OF THE INVENTION

A method for dispensing a sealing composition formed by mixing together predetermined quantities of two components that, after being mixed with each other, will react with each other to form a resiliently flexible solid sealing composition.

BACKGROUND INFORMATION

Known methods for dispensing sealing compositions formed by mixing together predetermined quantities of two components that, after being mixed with each other, will react with each other to form a resiliently flexible solid sealing composition include the use of multiple syringe-type dispensers that meter individual components at point of use into either a static or mechanically agitated mixer. Such dispensers have many disadvantages which can include difficulty in dispensing due to high back pressure, being cumbersome, having overall length and geometry that is poorly suited to the application, providing inefficient mixing, and presenting significant limitations on the volume ratios of components that may be mixed.

A known dispensing assembly used for dispensing a single component sealing material that is commercially available as the "Avon" model applicator gun from P. C. Cox, Newbury, England, comprises an elongate barrel having a through opening with a generally uniform cross sectional area, a plunger adapted to move along the through opening between rear and front ends of the barrel, manually activatable driving means for forcefully driving the plunger from the rear end to the front end of the barrel, a nozzle having a through passageway converging from an inlet to an outlet end and having a cross sectional area at its inlet end that is about the same as the cross sectional area of the through opening, and means for removably mounting the inlet end of the nozzle on the front end of the barrel. Typically, the single component sealing material to be dispensed by this assembly is packaged in a "sachet" comprising a generally cylindrical tube of flexible film, optionally with moisture and/or solvent barrier properties, which tube has heat seals, metal clips, or other closures at its ends. That sachet package is inserted into the through opening in the barrel, a portion of the periphery of the flexible package adjacent the front end of the barrel is removed, the inlet end of the nozzle is attached to the front end of the barrel, and the driving means is activated to compress the flexible sachet package and thereby dispense the sealing material through the nozzle. No separate seal is required between the sachet package and the nozzle. After all of the sealing material has been dispensed, the crushed sachet package and the nozzle are removed and discarded. Little, if any, of the sealing material will have been deposited on the inner surface of the barrel so that clean up of the barrel is minimal.

Flexible packages are known that comprise two opposite flexible walls having peripheries firmly attached to each other (e.g., by heat sealing or otherwise) to form a main chamber between the walls with the walls being separably attached to each (e.g., by a rupturable heat seal) along a line extending between spaced parts of those peripheries to divide the main chamber into two temporary main chamber portions, each sized to contain a different one of two parts or components. Examples of such a package are described in U.S. Pat. Nos. 2,932,385, 3,074,544 and 3,087,606. The components in such a package can be mixed by manually rupturing the seal along the line and kneading the package by hand to mix the components. As is described in U.S. Pat. No. 4,168,363, the components used in such a package can be fluid , but when mixed can thicken rapidly to a grease-like, non-flowing consistency for ease of application.

It is known to formulate polyurea-urethane compositions (e.g., sealants, coatings, foams, and the like) as two component systems. One component includes the isocyanate-reactive components such as polyols, together, typically with a catalyst and other customary additives, while the second component includes the polyisocyanate. The catalyst is separately packaged from the polyisocyanate in order to prevent premature gelation of the latter material. The two components are normally mixed immediately prior to application of the coating. Upon mixing the two components, the hydroxyl groups of the polyol chemically react with the isocyanate groups of the polyisocyanate, ultimately leading to gelation. At gelation, the reaction mixture rapidly loses its fluidity with an attendant pronounced increase in viscosity.

DISCLOSURE OF THE INVENTION

The present invention provides a novel combination and adaptation of parts of the known dispensing systems described above that provides a greatly improved method for dispensing a sealing composition formed by mixing together predetermined quantities of two fluid or low viscosity liquid components that, after being mixed with each other, will react with each other to form a resiliently flexible solid sealing composition.

That method according to the present invention generally comprises the steps of: (1) providing predetermined quantities of the two low viscosity liquid components that, when mixed with each other, will react with each other to form a sealing composition that while reacting is a higher viscosity, non-sag, non-flowing, thixotropic sealant composition for a period of time and will then form a resiliently flexible solid sealing composition; (2) providing a flexible package comprising two opposite flexible walls having peripheries firmly attached to each other to form a main chamber between the walls with the walls being separably attached to each along a line extending between spaced parts of said peripheries to divide the main chamber into two temporary main chamber portions each sized to at least contain a different one of the two liquid components; (3) positioning each of the two liquid components in the main chamber portion sized to contain it; (4) providing a dispensing assembly comprising an elongate barrel having a through opening with a generally uniform cross sectional area, a plunger adapted to move along the through opening between rear and front ends of the barrel, manually activatable driving means for forcefully driving the plunger from the rear end to the front end of the barrel, a nozzle having a through passageway converging from an inlet end to an outlet end and having a cross sectional area at its inlet end that is about the same as the cross sectional area of the through opening, and means for removably mounting the inlet end of the nozzle on the front end of the barrel; (5) breaking the separable attachment of the walls along the line and mixing the liquids together within the main chamber by manually manipulating the flexible walls; (6) inserting the flexible package containing the mixed liquids into the through opening in the barrel; (7) removing a portion of the periphery of the flexible package adjacent the front end of the barrel; (8) attaching the inlet end of the nozzle to the front end of the barrel; and (9)

manually activating the driving means within the aforementioned period of time to compress the flexible package and thereby dispense the viscous material through the nozzle.

Preferably, the step of providing a flexible package can comprise forming the main chamber to be elongate between first and second ends, and the step of inserting the flexible package containing the mixed liquids within the through opening in the barrel can comprise the step of coiling the flexible package about an axis extending between its first and second ends and inserting the coiled package axially into the through opening in the barrel. Additionally, that step of providing a flexible package can include forming the main chamber to be tapered adjacent its first end so that its second end is wider than its first end, and the coiled package is inserted in the barrel so that the first end of the package is adjacent the front end of the barrel.

The method according to the present invention combines most of the best qualities of the known multiple component and single component sealant handling technologies described above in that (1) the components from which the sealing material are mixed are fluid which makes them easy to manufacture and fill in precise quantities into the package, whereas thickening of the components when they are mixed facilitates applying them to substrates, (2) the package used is much less costly than the packages presently used in known dispensers for two component sealing materials, affords almost infinite variability in the ratio and number of components that can be mixed, affords easy, rapid, and complete mixing , and can be shaped to facilitate its use in the dispenser, and (3) the dispenser used has the same low weight and convenient shape as dispensers presently used for dispensing single component sealants as compared to the often long, heavy and bulky devices presently used for dispensing two component sealing materials.

The method according to the present invention will be useful where sealants formed from two or more components are to be applied to a substrate, particularly including sealants used to bond windshields into automobile bodies and sealants used in sealing seams or joints for automotive, marine, or building uses.

DESCRIPTION OF THE DRAWING

The present invention will be further described with reference to the accompanying drawing wherein like reference numerals refer to like parts in the several views, and wherein.

DETAILED DESCRIPTION

Figure 1:
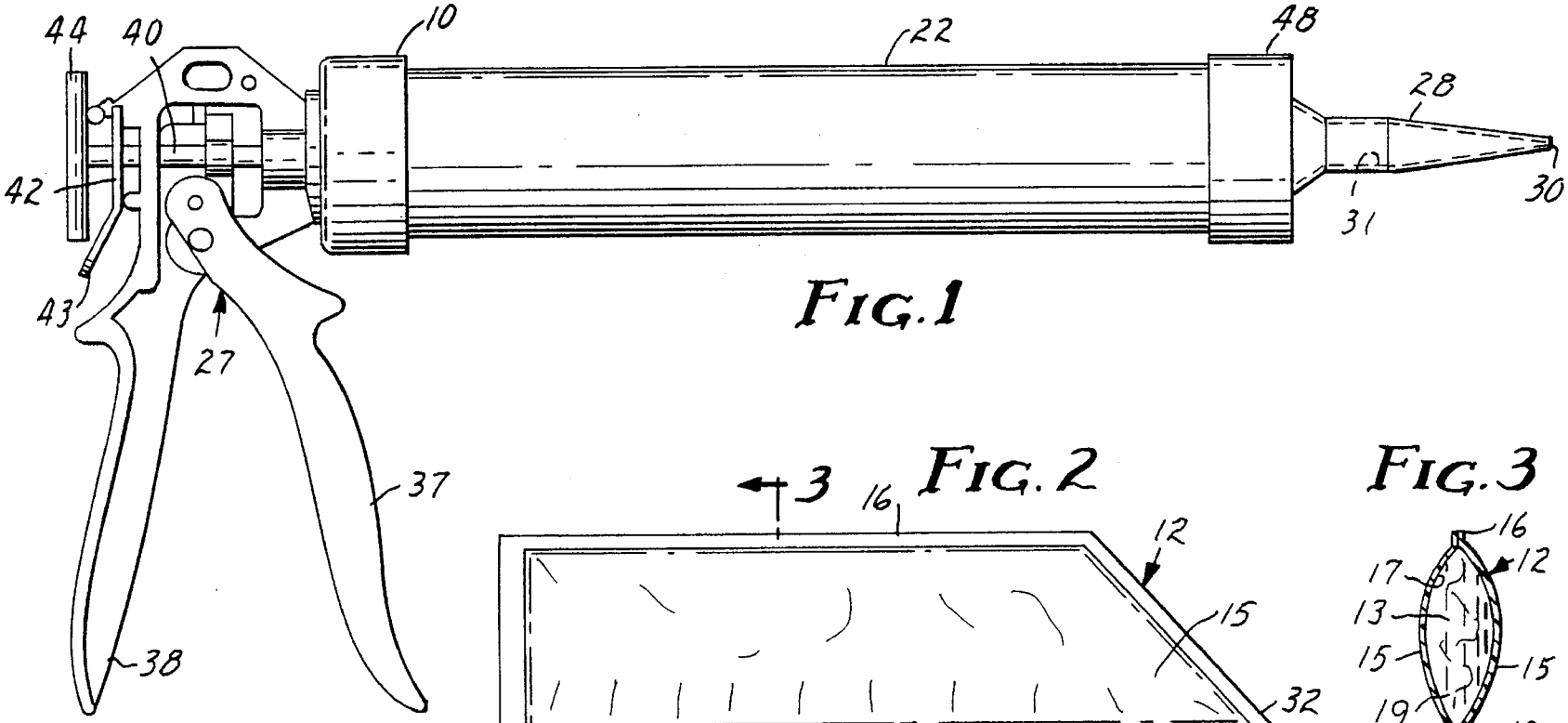
FIG. 1 is a side view of a dispensing assembly used in the method according to the present invention.

Referring now to the drawing there is illustrated the combination according to the present invention of a dispensing assembly 10 (FIGS. 1 and 11) and a flexible package 12 (FIGS. 2 through 9 and 11) containing two liquid components 13 and 14; and a method according to the present invention for dispensing a sealing composition using that combination.

Figure 4:
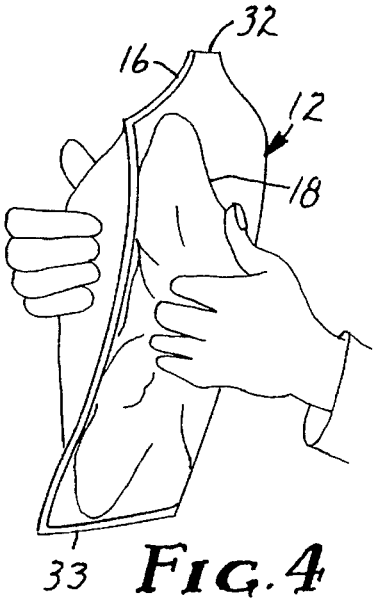
FIGS. 4 through 10 sequentially illustrate mixing of liquid components within the package of FIG. 2 and insertion of that package into the dispensing assembly of FIG. 1.
Figure 5:
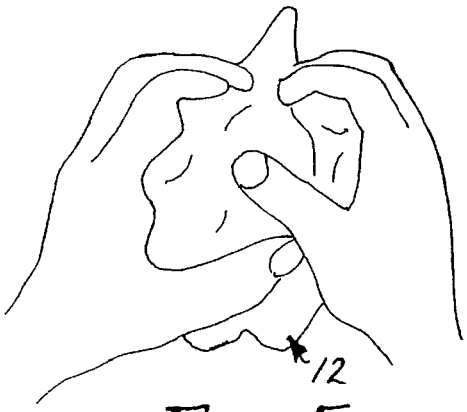
Figure 9:
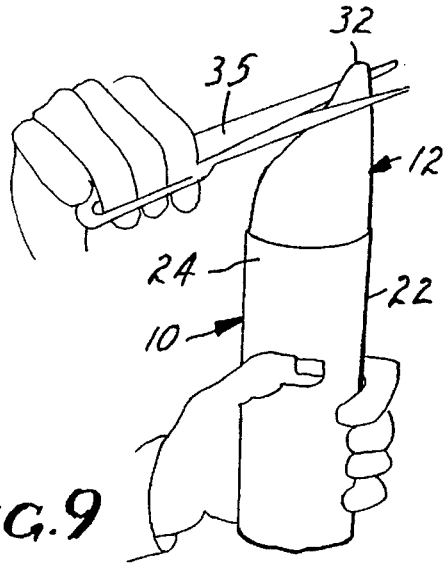
Figure 11:
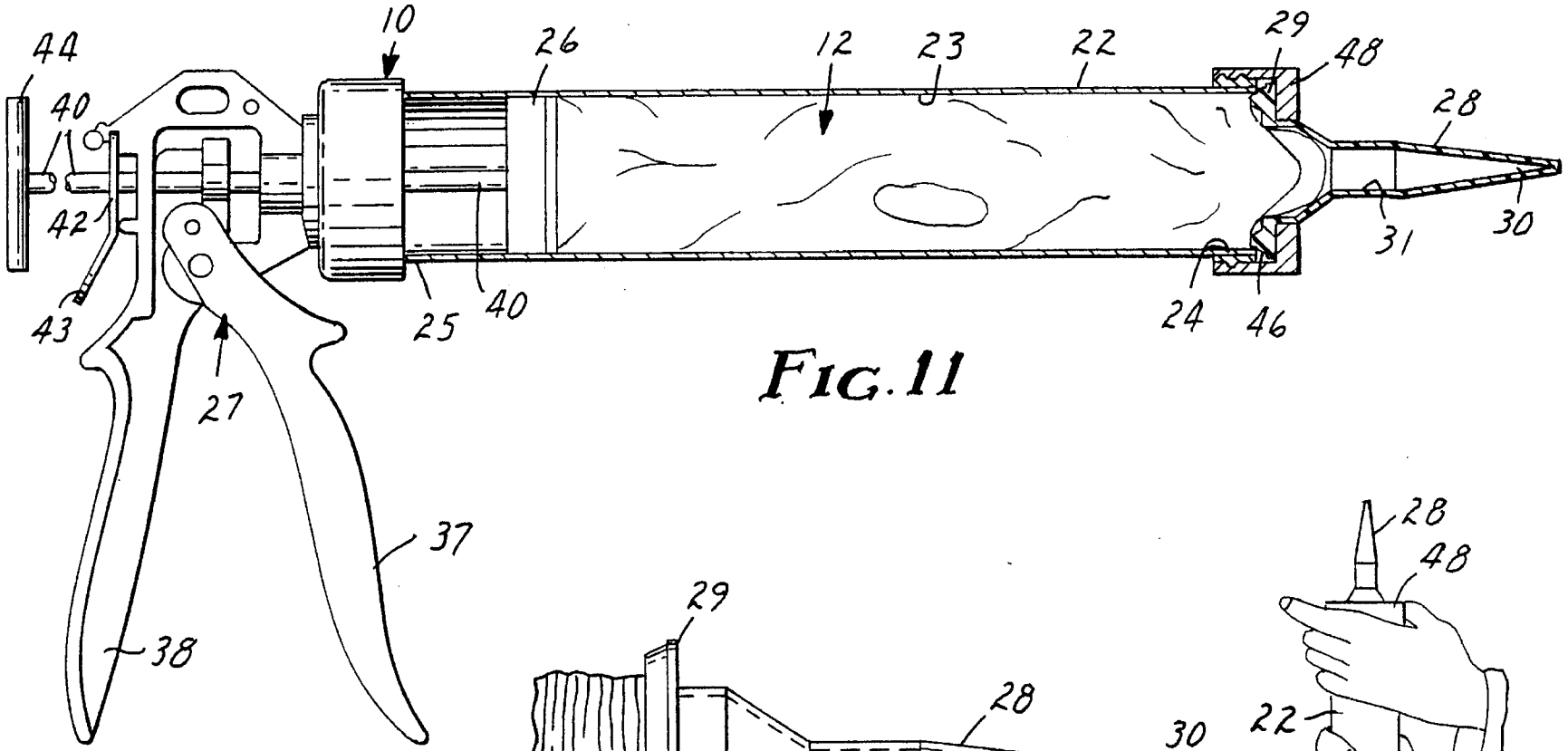
FIG. 11 illustrates dispensing sealing material from the package of FIG. 2 after it has been inserted into the dispensing assembly of FIG. 1 in the manner illustrated in FIGS. 4 through 10.
Figure 10:
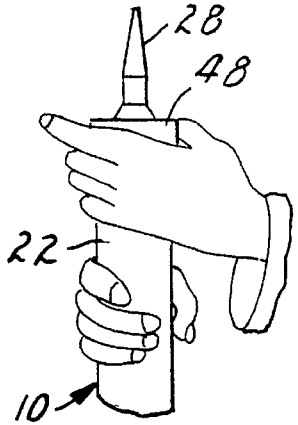
Figure 12:
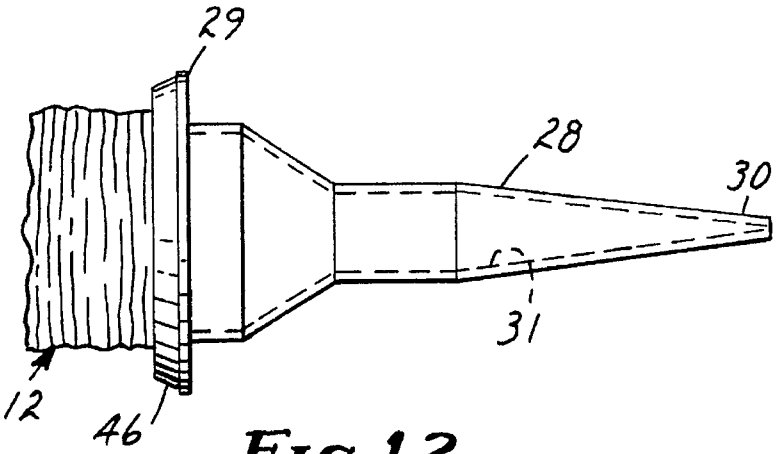
FIG. 12 illustrates the package of FIG. 2 and a nozzle of the dispensing assembly of FIG. 1 removed from that dispensing assembly after the sealing material has been dispensed from the package.

Generally, that method comprises the steps of (1) providing predetermined quantities of the two low viscosity liquid components 13 and 14 that, when mixed with each other, will react with each other to form a sealing composition that while reacting is a higher viscosity, non-sag, non-flowing, thixotropic material for a period of time and will then form a resiliently flexible solid sealing composition; (2) providing the flexible package 12 that comprises two opposite flexible walls 15 having peripheries 16 firmly attached to each other to form a main chamber 17 between the walls 15 with the walls 15 being separably attached to each other along a line 18 extending between spaced parts of those peripheries 16 to divide the main chamber 17 into two temporary main chamber portions 19 and 20 each sized to at least contain a different one of the two liquid components 13 and 14; (3) positioning each of the two liquid components 13 and 14 in the main chamber portion 19 or 20 sized to contain it; (4) providing the dispensing assembly 10 that comprises an elongate barrel 22 having a through opening 23 (see FIG. 11) with a generally uniform cross sectional area, a plunger 26 adapted to move along the through opening 23 between a rear end 25 and a front end 24 of the barrel 22, manually activatable driving means 27 for forcefully driving the plunger 26 from the rear end 25 to the front end 24 of the barrel 22, a nozzle 28 having a through passageway 31 converging from an inlet end 29 to an outlet end 30 and having a cross sectional area at its inlet end 29 that is about the same as the cross sectional area of the through opening, and means for removably mounting the inlet end 29 of the nozzle 28 on the front end 24 of the barrel 22; (5) breaking the separable attachment of the walls along the line 18 as is illustrated in FIG. 4, and mixing the liquids components 13 and 14 together within the main chamber 17 by manually manipulating the flexible walls 15 as is illustrated in FIG. 5; (6) inserting the flexible package 12 containing the mixed liquid components 13 and 14 into the through opening 23 in the barrel 22 as is sequentially illustrated in FIG. 6 through 8; (7) cutting open the main chamber 17 in the flexible package 12 adjacent the front end 24 of the barrel 22 as is illustrated in FIG. 9; (8) attaching the inlet end 29 of the nozzle 28 to the front end 24 of the barrel 22 as is illustrated in FIG. 10; and (9) manually activating the driving means 27 within the aforementioned period of time to compress the flexible package 12 as is illustrated in FIG. 11 to thereby dispense the viscous material through the nozzle 28. After the viscous material is all dispensed from the package 12, the crushed package 12 and the nozzle 28 (which is an inexpensive polymeric molding) can be removed together from the barrel 22 and disposed of (see FIG. 12). Little if any of the viscous material from the package 12 will be on the inner surface of the barrel 22, so that no significant clean up of the dispensing assembly 10 will be required.

Figure 2:
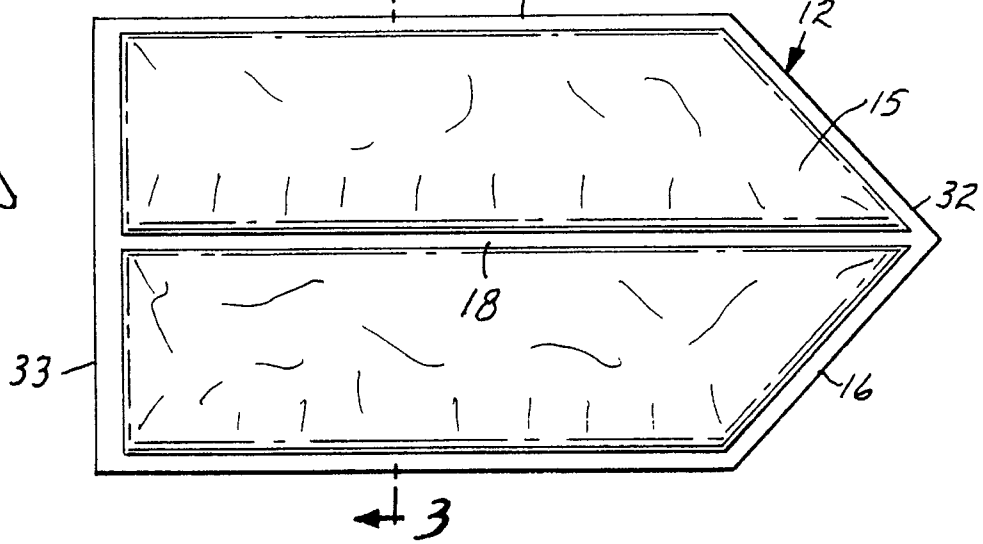
FIG. 2 is a plan view of a flexible package used in the method according to the present invention.
Figure 3:
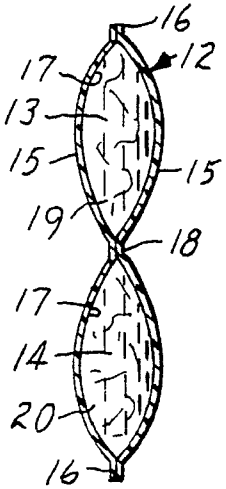
FIG. 3 is a sectional view taken approximately along line 3—3 of FIG. 2.
Figure 6:
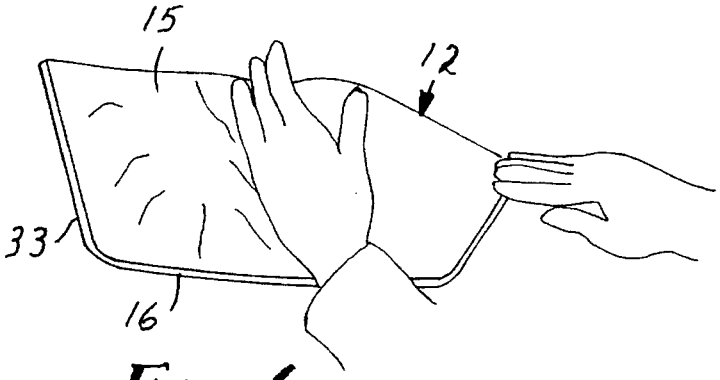
Figure 8:
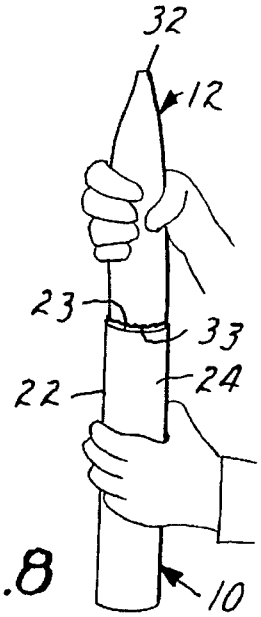
Figure 7:
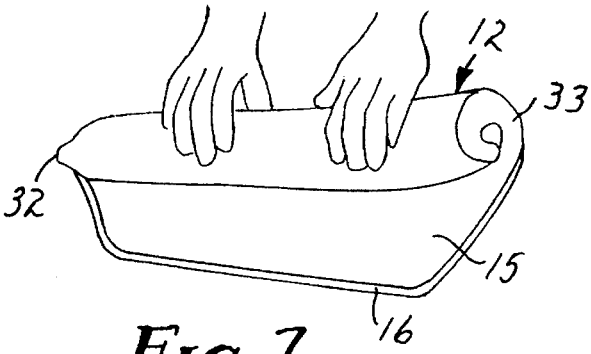

As illustrated in FIG. 2, preferably the flexible package 12 is elongate between first and second ends 32 and 33 with the main chamber 17 being tapered adjacent its first end 32 so that its second end 33 is wider than its first end 32; and as is illustrated in FIGS. 6 through 8 the previously recited step of inserting the flexible package 12 containing the mixed liquid compounds 13 and 14 within the through opening 23 in the barrel 22 comprises the steps of generally flattening the package 12 in a plane parallel to the peripheries 16 of its walls 15 after the liquid components are mixed as is illustrated in FIG. 6, rolling or coiling the thus flattened flexible package 12 about an axis extending between its first and second ends 32 and 33 as is illustrated in FIG. 7, and inserting the coiled package 12 axially into the through opening 23 in the barrel 22 as is illustrated in FIG. 8 so that after the package 12 is inserted the first end 32 of the package 12 is adjacent the front end 24 of the barrel 22. The main chamber 17 can then be opened to provide an opening from the main chamber 17 of a generally predetermined size that is generally centered in the inlet end of the nozzle 28 by removing the first end 32 of the package 12 as with a scissors 35 as is illustrated in FIG. 9.

The dispensing assembly 10 is of a known type that has long been used for dispensing a single component sealing material from a sachet package, and is commercially available as the "Avon" model applicator gun from P. C. Cox, Newbury, England. The manually activatable driving means 27 on the dispensing assembly 10 for forcefully driving the plunger 26 from the rear end 25 to the front end 24 of the barrel 22 is of a well known mechanical type in which force applied manually by a users hand to squeeze a pivotally mounted lever 37 toward a fixed lever 38 on a frame of the dispensing assembly 10 is transferred from the lever 37 to a rod 40 having one end attached coaxially to the plunger 26. Successive movements of the pivotally mounted lever 37 toward the fixed lever 38 forcibly advancing the rod 40 and plunger 26 toward the front end 24 of the barrel 22, and the advanced position of the plunger 26 is releasably retained against pressure developed in the package 12 by a latch plate 42 at the rear of the fixed lever 38. After manually releasing the latch plate 42 by pressing on an end portion 43 thereof, the rod 40 and plunger 26 can be manually pulled at a transverse handle 44 at the end of the rod 40 to return the plunger 26 from the front end 24 to the rear end 25 of the barrel 22. The nozzle 28 is a polymeric molding that is sufficiently inexpensive that it is typically discarded rather than being cleaned after material is dispensed through it. Typically, before the nozzle 28 is used, an end portion of the nozzle 28 is cut away at a location that will provide an outlet opening of a desired size and orientation. The inlet end of the nozzle 28 is formed by a flange that has a beveled surface 46 around its periphery shaped to engage a mating end surface at the front end 24 of the barrel 22 so that the nozzle closes the entire end of the barrel 22. The means for removably mounting the inlet end 29 of the nozzle 28 on the front end 24 of the barrel 22 is a collar 48 that has a radially inwardly projecting portion that engages the outer surface of the nozzle flange and has a central opening through which a smaller portion of the nozzle 28 projects, and an axially extending portion that has internal threads that releasably engage external threads around the barrel 22 adjacent its front end 24, and an outer surface adapted for manual engagement so that the collar 48 and the nozzle 28 can be manually attached to or removed from the barrel 22.

The walls 15 of the flexible package 12 can be formed of a laminate of a 48 gauge polyester outer layer, a 0.0089 millimeter (0.00035 inch) thick middle layer of aluminum type 1145, and an inner layer of 0.0762 millimeter (0.003 inch) thick linear low density polyethylene, which laminate is commercially available from Ludlow Corporation, Lombard, Ill. The peripheries 16 of the walls 15 are permanently attached together by heat sealing to form a hermetically sealed flexible package 12 that prevents the two components 13 and 14 in the package 12 from being exposed to moisture before usage. The separable seal along the line 18 is formed by methods such as those described in U.S. Pat. Nos. 2,932,385; 3,074,544 and 3,087,606 to Bollmeier et al (the contents whereof are incorporated herein by reference) to insure separation of the two components 13 and 14 until that seal is manually broken.

Alternatively, the walls 15 of the flexible package 12 can be formed in the same manner of a laminate of a 0.0127 millimeter (0.0005 inch) thick medium density polyethylene outer layer, a 0.0127 millimeter (0.0005 inch) thick middle layer of polyester, and an inner layer of 0.0889 millimeter (0.0035 inch) thick linear low density polyethylene, such as the material commercially designated "Scotchpack" X29905 that is available from Minnesota Mining and Manufacturing Company, St. Paul, Minn. When the walls 15 of the flexible package 12 are formed from this material, the package 12 should be enclosed in a heat sealed pouch (not shown) having walls that are a laminate of a 25 pound M.G. bleached craft paper outer layer, a 48 gauge polyester first inner layer, a 0.0127 millimeter (0.0005 inch) thick second inner layer, and an innermost layer of 0.00762 millimeter (0.0003 inch) thick linear low density polyethylene. Such a pouch will provide a hermetical seal and protection from moisture that is needed before usage for the two components 13 and 14 in the package.

Preferably the liquid components 13 and 14 in the flexible package 12 are a two-component reaction system for producing a polyurethane that includes a catalyst system which effects the onset of cure after the components are mixed together to provide a short gel time period (e.g., in the range of 5 to 60 minutes) during which the sealing material can be dispensed to and shaped on a substrate but which then allows the sealing material to cure rapidly to a resiliently flexible solid without the need for any special curing procedures. Such liquid components that produce a polyurethane having an isocyanate index of at least 100 or greater in value include:

(a) a first liquid component comprising a polyisocyanate material;

(b) a second liquid component comprising:
  (i) a polyol material;
  (ii) a polyurethane catalyst comprising a bismuth/zinc polyurethane catalyst; and
  (iii) a molar excess of a complexing agent for the polyurethane catalyst, where the complexing agent is a mercaptan compound (e.g., a mercaptoalkylalkoxy silane, a thioglycol, an alkylthiol, or mixtures thereof).

The bismuth/zinc polyurethane catalyst comprises a physical mixture of a bismuth salt and a zinc salt. Preferably, the bismuth salt and zinc salt are organometallic catalytic compounds of bismuth and zinc, respectively.

Preferably the polyisocyanate material and the polyol material are used in amounts that provide an isocyanate index of from 105 to 150.

Also, preferably the sealing material should show at least a five-fold increase in viscosity within a time span of less than 10 minutes after the liquid components (a) and (b) are thoroughly mixed together, where the viscosity is measured using a Brookfield rheometer with a T-F spindle at 2 rpm in conjunction with a helipath at a temperature of 23° C. and at approximately 50% relative humidity. Such sealing materials offer a highly useful controlled onset of cure together with a relatively rapid cure well-suited for applications such as windshield sealing, and also have wetting and tack properties compatible for coating of a wide variety of different types of materials.

An example of component (a) described above was made as follows. To a 12 liter reaction vessel fitted with a nitrogen purge was added 4918 g of a polyether triol with an average molecular weight of 6000 obtained under the trade name E2306 from ARCO Chemical Company, 2420 g of a polyether diol having an average molecular weight of 2000 obtained under the trade name PPG 2025 from ARCO Chemical Company, 200 g of a polyether diol having an average molecular of 1000 obtained under the trade name PPG 1025 from ARCO Chemical Company, and 825 g of a partially hydrogenated terphenyl as plasticizer obtained under the trade name HB 40 from Monsanto Co. Those materials were treated with 3500 g of 4,4'-diphenyl methane diisocyanate obtained under the trade name Mondur M from Miles Inc., and allowed to react at 80° C. with agitation. After the exothermic reaction ended, in which the temperature was not allowed to exceed 110° C., a prepolymer resulted with an isocyanate content of 8.1%.

An example of component (b) described above was made as follows. To a 4 liter reaction vessel fitted with nitrogen purge was added about 670 g of a polyether triol with an average molecular weight of 6000 obtained under the trade name E2306 from ARCO Chemical Company, about 670 g of a polyether diol having an average molecular weight of 2000 obtained under the trade name PPG 2025 from ARCO Chemical Company, about 331 g of a polyether diol having an average molecular of 1000 obtained under the trade name PPG 1025 from ARCO Chemical Company, about 117 g of 1,4-butanediol, about 40.3 g of 4,4'-methylene-bis-(2,6-diethylaniline) obtained under the trade name Lonzacure M-DEA from Lonza Co., about 32 g of (3-mercaptopropyl)trimethoxysilane obtained under the trade name A-189 from OSi Specialties Inc., and 1.2 g of a catalyst made by mixing the following reagents: 670 grams of E2306, 670.2 grams of PPG 2025, 331 grams of PPG 1025, 117.1 grams of 1,4-butanediol, 40.2 grams of M-DEA, 31.9 grams of A-189, and 1.2 grams of a 50:50 mixture, by weight, of bismuth and zinc neodecanoates obtained from Shepherd Chemical Company. Those materials were mixed for 1 hr at 50° C. with agitation to make component b.

100 g of liquid component (a) made as described above and 76 g of liquid component (b) made as described above were mixed together and reacted with each other to form a sealing composition that while reacting was a higher viscosity, non-sag, non-flowing, thixotropic sealant composition for about 15 to 20 minutes and then formed a resiliently flexible solid or gelled sealing composition or material with an isocyanate index of 105.

The present invention has now been described with reference to one embodiment thereof. It will be apparent to those skilled in the art that many changes can be made in the embodiment described without departing from the scope of the present invention. For example, the flexible package 12 could be modified to provide three or more temporary main chamber portions each sized to contain a different one of three or more liquid components which can be mixed together in the chamber in the manner described above. Thus, the scope of the present invention should not be limited to the method and structure described in this application, but only by the methods and structures described by the language of the claims and the equivalents thereof.

I claim:

1. A method for dispensing a sealing composition comprising the steps of:

providing predetermined quantities of two low viscosity liquid components that, when mixed with each other, will react with each other to form a sealing composition that while reacting is a higher viscosity, non-sag, non-flowing, thixotropic sealant composition for a period of time and will then form a resiliently flexible solid sealing composition;

providing a flexible package comprising two opposite flexible walls having peripheries firmly attached to each other to form a main chamber between the walls with the walls having a separable attachment to each other along a line extending between spaced parts of said peripheries to divide the main chamber into two temporary main chamber portions each sized to at least contain a different one of the two liquids;

positioning each of the two liquids in the main chamber portion sized to contain it;

providing a dispensing assembly comprising an elongate barrel having a through opening with a generally uniform cross sectional area and opposite front and rear ends, a plunger adapted to move along the through opening between the rear end and the front end of the barrel, manually activatable driving means for forcefully driving the plunger from the rear end to the front end of the barrel, a nozzle having inlet and outlet ends, a through passageway smoothly converging from said inlet to said outlet end and having a cross sectional area at said inlet end that is about the same as the cross sectional area of the through opening, and means for removably mounting the inlet end of said nozzle on the front end of said barrel;

breaking the separable attachment of the walls along the line and mixing the liquids together within the main chamber by manually manipulating the flexible walls;

inserting the flexible package containing the mixed liquids into the through opening in the barrel;

removing a portion of the periphery of the flexible package adjacent the front end of the barrel;

attaching the inlet end of the nozzle to the front end of the barrel; and manually activating the driving means within the period of time to compress the flexible package and thereby dispense the viscous material through the nozzle.

2. A method according to claim 1 wherein said step of providing a flexible package comprises forming the main chamber to be elongate between first and second ends, and said step of inserting the flexible package containing the mixed liquids within the through opening in the barrel comprises the step of coiling the flexible package about an axis extending between said first and second ends and inserting said coiled package axially into the through opening in the barrel.

3. A method according to claim 1 wherein said step of providing a flexible package comprises forming the main chamber to be elongate between first and second ends with the main chamber being tapered adjacent said first end so that said second end is wider than said first end, and said step of inserting the flexible package containing the mixed liquids within the through opening in the barrel comprises the step of coiling the flexible package about an axis extending between said first and second ends and inserting said coiled package axially into the through opening in the barrel so that after the package is inserted the first end of the package is adjacent the front end of the barrel.

4. A combination for use in dispensing a sealing composition, said combination comprising:

a flexible package comprising two opposite flexible walls having peripheries firmly attached to each other to form a main chamber between the walls with the walls having a separable attachment to each other along a line extending between spaced parts of said peripheries to divide the main chamber into two temporary main chamber portions;

predetermined quantities of two low viscosity liquid components, each of said components being in a different one of said temporary main chamber portions and being adapted, upon being mixed with each other, to react with each other to form a sealing composition that while reacting is a higher viscosity, non-sag, non-flowing, thixotropic sealant composition for a period of time and to then form a resiliently flexible solid sealing composition; and a dispensing assembly comprising an elongate barrel having a through opening with a generally uniform cross sectional area and opposite front and rear ends, a plunger adapted to move along the through opening between the rear end and the front end of the barrel, manually activatable driving means for forcefully driving the plunger from the rear end to the front end of the barrel, a nozzle having inlet and outlet ends, a through passageway smoothly converging from said inlet to said outlet end and having a cross sectional area at said inlet end that is about the same as the cross sectional area of the through opening, and means for removably mounting the inlet end of said none on the front end of said barrel so that when the separable attachment of the walls of said package is manually broken along line and the liquids are mixed together within the main chamber by manually manipulating the flexible walls, the flexible package containing the mixed liquids is inserted into the through opening in the barrel, a portion of the periphery of the flexible package adjacent the front end of the barrel is removed, the inlet end of the nozzle is attached to the front end of the barrel by said means for removably mounting; and the driving means is manually activated within said period of time to compress the flexible package, the viscous material will be dispensed through the nozzle.

5. A combination according to claim 4 wherein the package has first and second ends, and the chamber in the package is elongate between said first and second ends and is tapered adjacent said first end with said second end being wider than said first end so that the flexible package can be coiled about an axis extending between said first and second ends and inserted axially into the through opening in the barrel to position the first end of the package adjacent the front end of the barrel.

* * * * *